US005417159A

United States Patent [19]

Mains, Sr.

[11] Patent Number: 5,417,159

[45] Date of Patent: May 23, 1995

[54] METHOD AND APPARATUS FOR PRINTING SIDE EDGES OF SHEET STACK

[76] Inventor: Ronald D. Mains, Sr., 234 Lake, P.O. Box 163, Hanover, Mich. 49241

[21] Appl. No.: 114,179

[22] Filed: Sep. 1, 1993

[51] Int. Cl.[6] ..... B41F 17/00

[52] U.S. Cl. ..... 101/476; 101/35

[58] Field of Search ..... 101/476, 35, 41–44, 101/36, 37

[56] References Cited

U.S. PATENT DOCUMENTS

| | | | |
|---|---|---|---|
| 690,697 | 1/1902 | Cheshire | 101/476 |
| 1,535,539 | 9/1923 | Mitton | 101/35 |
| 2,109,590 | 3/1938 | Kimball | 101/35 |
| 2,171,362 | 5/1938 | Gulliksen | 101/35 |
| 2,286,458 | 6/1942 | Bowman et al. | 101/41 |
| 3,080,813 | 3/1963 | Staub et al. | 101/43 |
| 3,773,601 | 11/1973 | Steffa | 101/476 |
| 4,263,845 | 4/1981 | Okamura | 101/35 |

FOREIGN PATENT DOCUMENTS

| | | | |
|---|---|---|---|
| 0732958 | 3/1943 | Germany | 101/35 |
| 2053824 | 2/1981 | United Kingdom | 101/35 |

*Primary Examiner*—Edgar S. Burr
*Assistant Examiner*—Anthony H. Nguyen
*Attorney, Agent, or Firm*—Beaman & Beaman

[57] ABSTRACT

The method and apparatus for printing the side edges of sheet stacks, such as books, catalogs, and the like, wherein after the stack side edge has been trimmed and cut the stack sheets are maintained in relationship under slight compression within a belt conveyor using upper and lower belts. As the retained stack is translated through the printer a sensor senses the location of the stack leading edge initiating a timing circuit which controls a rotary printing head engageable with the stack side edge to print indicia upon the side edge at the desired location. The movement of the stack rotates the printing head and a dense high quality image is produced. In an embodiment of the invention, a plurality of printing heads are mounted upon the conveyor apparatus to print the stack edge, sequentially, with a plurality of colored ink.

11 Claims, 3 Drawing Sheets

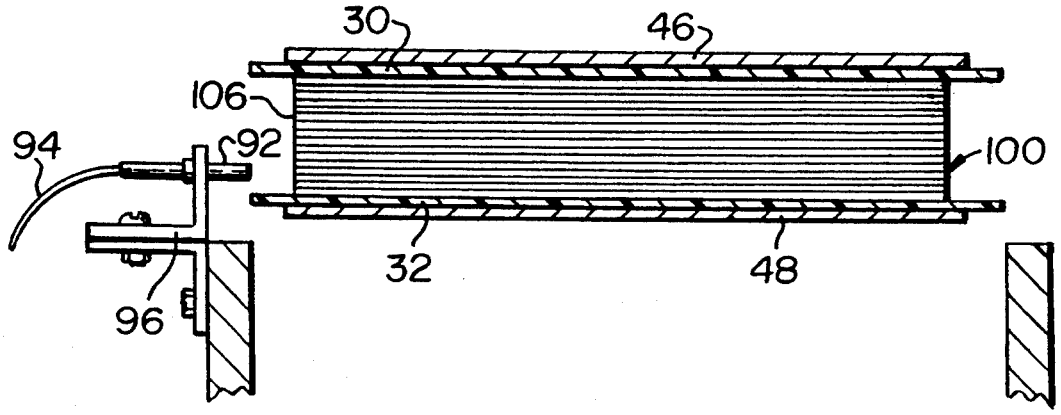
Fig-3
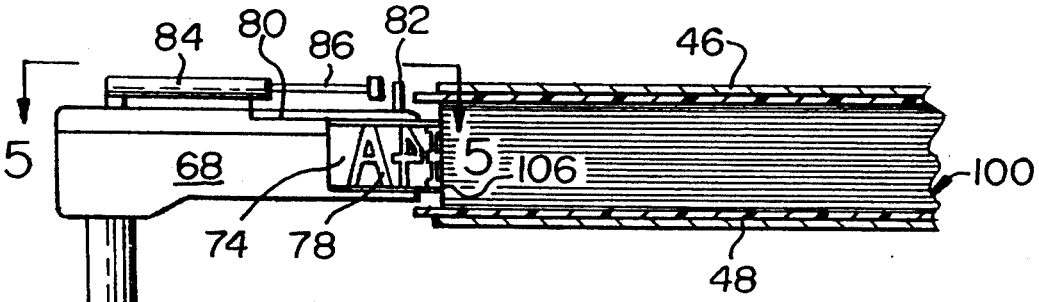
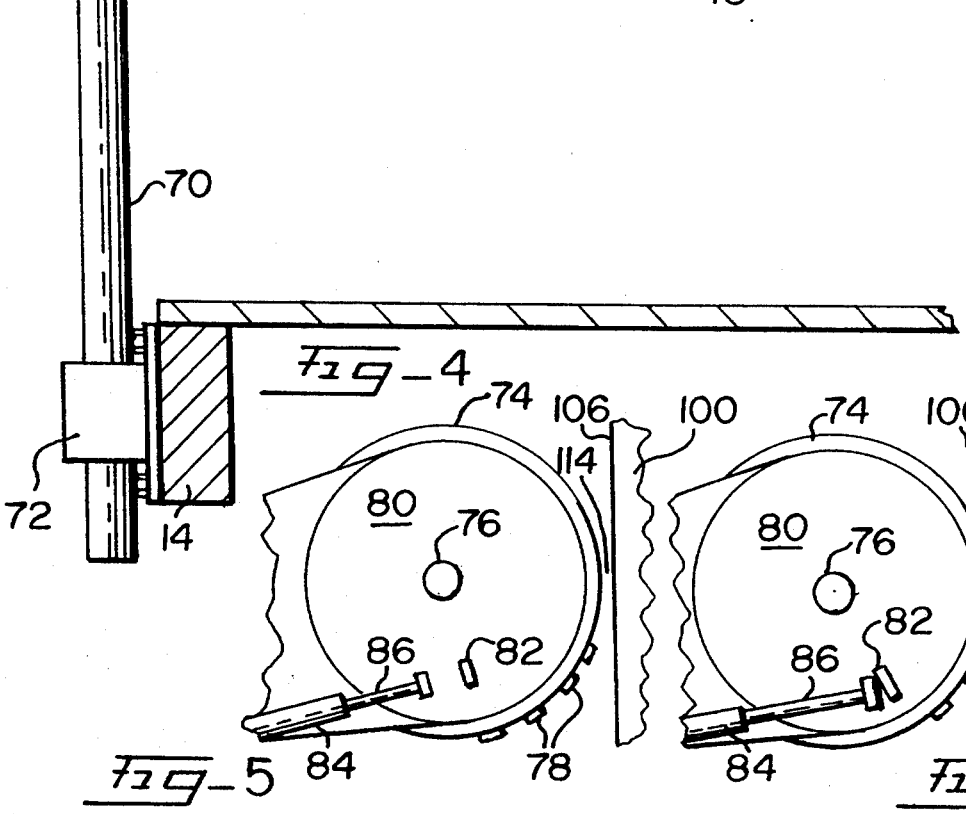
Fig-4
Fig-5
Fig-6

METHOD AND APPARATUS FOR PRINTING SIDE EDGES OF SHEET STACK

BACKGROUND OF THE INVENTION

1. Field of the Invention

The invention pertains to the method and apparatus of printing the side edges of stacked sheets, such as the pages of a catalog, with type to produce a dense sharp image on the sheet edges.

2. Description of the Related Art

In the manufacture and assembly of stacked sheets, particularly those sheets constituting a book, catalog, reference materials, specification sheets, or the like, it is often desirable that indicia and information appear on the side edges of the stack of sheets. Such indicia may be for the purpose of indicating the location of the contents of the stacked sheets, or may constitute advertising or other information.

In the past, considerable difficulty has been encountered in the application of indicia to the edges of stacked sheets. Such difficulty is a combination of several factors, such as the fact that the stacked sheets constitute a plurality of substrata each only exposing a very thin edge to the ink or marking material. It has been difficult, during the printing of the edges of stacked material, to maintain the stacked sheets in a properly aligned and oriented manner, and in the past most indicia applied to the side edges of books, catalogs, reference material, and the like, have been applied by a digital sprayed jet process wherein the image is produced by a plurality of small jet sprayed dots. The use of a jet to form side edge printing does not result in a dense and sharp image, and as the stacked material is "fanned" the image is further blurred and dissipated. The need for an improved side edge printer for stacked sheets has long been recognized.

OBJECTS OF THE INVENTION

It is an object of the invention to provide an economical method and apparatus for printing the side edges of stacked sheets wherein a dense and sharp printing image is attained.

Another object of the invention is to provide a method and apparatus for printing the side edges of stacked sheets having front and rear edges, i.e. top and bottom edges, such that the side edge applied type may be accurately located, centered, and otherwise placed upon the stacked sheet side edges at the same position on sequentially printed stacks, and where a consistency of type placement is achieved.

Yet another object of the invention is to provide a method and apparatus for printing the side edges of stacked sheets wherein the sheets are maintained in a compressed and oriented manner immediately after trimming to insure a flat planar printing surface.

Yet another object of the invention is to provide a method and apparatus for printing the side edges of stacked sheets wherein the location of the printing on the side edges may be readily varied and adjusted.

An additional object of the invention is to provide a method and apparatus for printing the side edges of stacked sheets wherein the sheets are maintained in a compressed and oriented manner by a pair of belt conveyors and the belt conveyors are accurately driven by a common tension member to insure an equal rate of movement, and yet the drive of the belt conveyors permits the spacing therebetween to be readily adjusted in order to accommodate various thicknesses of stacked sheets.

Another object of the invention is to provide a method and apparatus for printing the side edges of stacked sheets wherein the printing is accomplished by a rotatable printer head upon which the type is defined, and engagement of the type with the side edge of the stacked sheets as the stack is translated past the printer wheel rotates the wheel.

SUMMARY OF THE INVENTION

The side edge printer of stacked sheets in accord with the invention is placed within a conveyor system for the stacked sheets, preferably directly behind the stack edge trimmer. At such location the trimming of the stack edges will produce a planar surface suitable for printing.

In order to maintain the recently trimmed sheet cut edges in an aligned manner to provide the flat printing surface required, the printer includes upper and lower belt conveyors between which the stack is compressed and simultaneously translated. The rate of movement of the belts of the upper and lower conveyors is identical, and the spacing between the conveyors may be easily adjusted to accommodate various thicknesses of stacks of sheets.

While the stack is being translated through the printer belt conveyor, its "forward" edge is sensed in order to determine the location of the stack within the printer, and upon the passage of a pre-determined time interval from the sensing of the stack front edge during stack translation a rotary printing head adjacent the belt conveyors is actuated to engage the stack side edge with the printer wheel type whereby this engagement will rotate the printer wheel, and the ink on the printer wheel type will be transferred to the stack side edge producing the desired imprint. Because the initiation of the operation of the rotary wheel is accurately determined by the stack sensor the location of the imprint upon the stack side edge may be very accurately controlled and regulated.

The frictional engagement between the stack side edge and the rotary wheel type will rotate the printer wheel, and upon the printing being completed the printer wheel is indexed to its next starting position, i.e. that position of the rotary wheel immediately prior to the type engaging the stack side edge.

The printed stack is conveyed to a belt conveyor, or other receiver, "behind" the side edge printer, and the stack may now be further processed, such as punched, bound, packaged, wrapped, or other appropriate procedure.

Because the type located on the printer wheel is of a conventional configuration, although the type is somewhat soft so as to conform to the configuration of the side edge, a high density and solid imprint is applied to the stack side edge. The type on the rotary printer wheel is inked during each revolution, and the invention is capable of the high quality printing of stacked sheet side edges under high production requirements.

BRIEF DESCRIPTION OF THE DRAWINGS

The aforementioned objects and advantages of the invention will be appreciated from the following description and accompanying drawings wherein:

FIG. 3 is an elevational sectional view through the printer illustrating the stack sensor as taken along Section 3—3 of FIG. 2, FIG. 4 is an elevational sectional view taken through the printer along Section 4—4 illustrating the relationship of the rotary printer head to the stack, FIG. 5 is an enlarged detail plan view taken along Section 5—5 of FIG. 4 illustrating the position of the rotary printer head prior to engagement of the printer head type with the stack side edge, FIG. 6 is a top plan view similar to FIG. 5 illustrating the relationship between the printer head type and stack side edge during printing.

DESCRIPTION OF THE PREFERRED EMBODIMENTS

Figure 1:
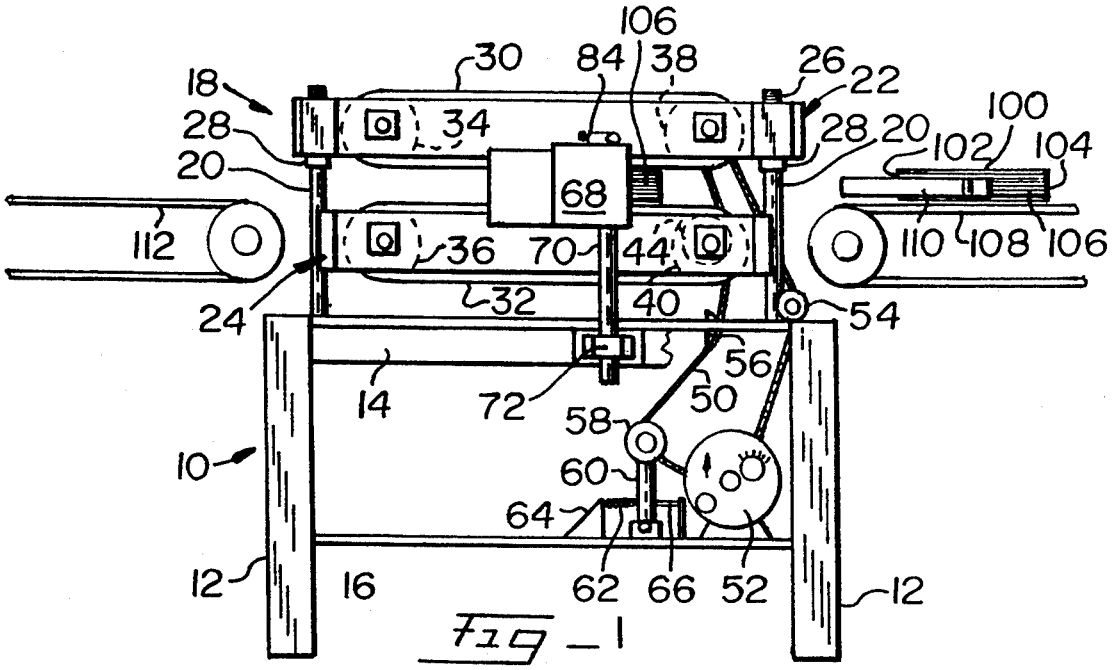
FIG. 1 is an elevational side view of a stacked sheet side edge printer in accord with the invention.
Figure 2:
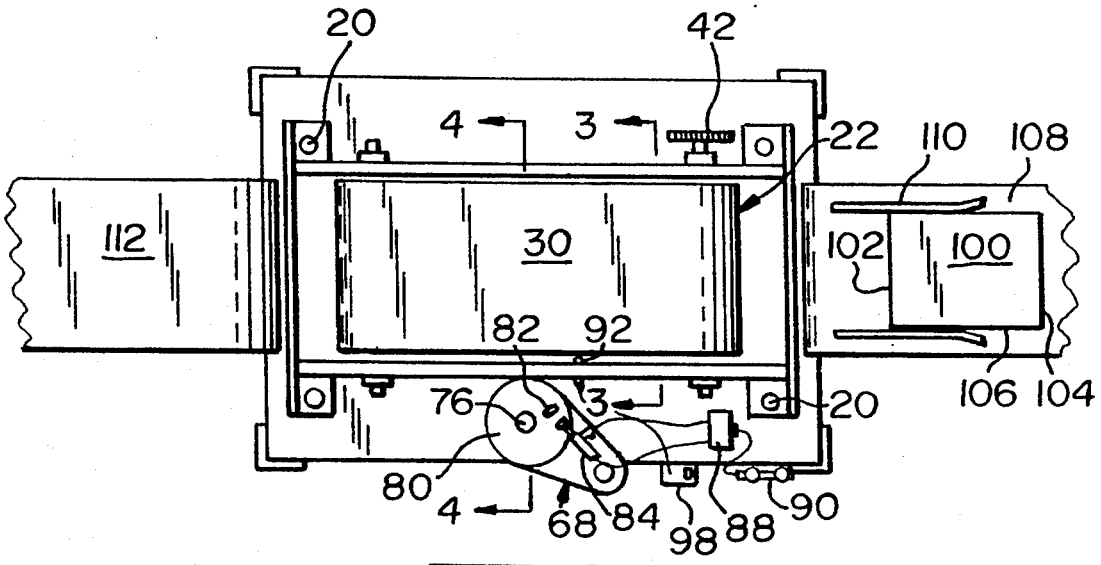
FIG. 2 is a top plan view of the printer of FIG. 1.

As will be appreciated from FIGS. 1 and 2, the stack printer in accord with the invention includes a substantially rectangular base 10 including legs 12 interconnected by side rails 14, and end rails, not shown. A motor support shelf 16 is mounted upon the legs 12 below the side rails as will be appreciated from FIG. 1.

The printer conveyor is generally indicated at 18, and is supported above the base 10 upon four columns 20 extending from the base. The conveyor 18 consists of the upper conveyor 22, and the lower conveyor 24. The conveyors 22 and 24 are mounted upon the columns 20, and the upper ends of the column 20 are threaded at 26 whereby the upper conveyor 22 may be supported upon annular collars 28 surrounding the columns 20 which are threaded upon threads 26. In this manner, rotation of the collars 28 will permit the upper conveyor 22 resting upon the collars to be vertically adjusted with respect to its spacing from the lower conveyor 22 permitting the side edge printer to accommodate various thicknesses of stacks of sheets.

The upper and lower conveyors respectively include conveyor belts 22 and 24 of approximately ten inches in width. The conveyors respectively include idler rollers 34 and 36 about which the belts 32 and 34 pass, and the belt 30 is driven by a drive roller 38 while the belt 32 is driven by a driver roller 40. The drive roller 38 is fixed upon the bearing supported shaft upon which the chain sprocket 42 is mounted, and the lower conveyor belt 32 is, likewise, mounted upon a shaft having a chain sprocket 44 mounted thereon. As will be appreciated from FIGS. 3 and 4, conventional back up plates 46 and 48 are associated with the lower and upper portions of conveyor belts 30 and 32, respectively, to guide the belt and laterally position the same. The back up plates 46 and 48 are supported upon associated conveyor structure and prevent the lower portion of the belt 30 and the upper portion of the belt 32 from being vertically displaced while the stack of sheets is being translated, as later described.

The conveyors 22 and 24 are operated by a tension member, such as chain 50, which extends about the sprocket 42, and extends around the right portion of the sprocket 44 as viewed in FIG. 1. The chain 50 is driven by a sprocket, not shown, mounted on electric motor 52 supported upon shelf 16, and idler sprocket 54 mounted upon base 10 guides the tensioned part of the chain 50 during normal operation. The non-tensioned portion of the chain 50 passes over a guide 56 and around an idler sprocket 58 mounted upon arm 60 pivotally supported upon shelf 16. A tension spring 62 biases the arm 16 in a counter-clockwise direction, the spring being mounted upon shelf mounted anchor 64, and a threaded stop 66 is also mounted upon shelf 16 to limit pivoting of the arm 60 in a clockwise direction.

The electric motor 52 is preferably of the permanent magnet DC type of ¾ horsepower, and uses a matched speed controlling Model No. 2Z846 manufactured by Dayton Manufacturing Company. The motor 52 is reversible, but would only be reversed with respect to the normal direction of rotation if a problem occurs.

The printing of the stack side edge is accomplished by a printer head 68 mounted adjacent the conveyors 22 and 24, at a side thereof, and the printer head 68 is supported upon a vertical column 70 adjustably supported within a bracket 72 attached to a base side rail 14. By means of the column 70 and bracket 72, the vertical position of the printer head 68 relative to the conveyor 18 and sheet stack may be easily adjusted.

The printer head 68 is of the rotarywheel type, and preferably is manufactured by Kiwi Coders Corporation of Wheeling, Ill., Series 450. The printer head includes a rotatable printer wheel 74 rotating about vertical shaft 76 located within head 68, and the type 78 is mounted upon the printer wheel as will be appreciated from FIGS. 4–6. Preferably, the type 78 is formed of a material of a resilient nature to apply a high density and sharp image to the stack side edge, and establish a frictional relationship to the stack side edge during stack translation.

The printer head 68 includes a cover wheel 80 also rotatable about the shaft 76 and fixed with respect to the printer wheel 74. The cover wheel 80 includes an abutment 82 for cooperation with the printer wheel actuator as later described.

A double acting air cylinder 84 is mounted upon the printer head 68, and may be of the type manufactured by American Cylinder Company, Inc. of Peotone, Ill., Model No. 750-DN-4.00, and the cylinder includes the reciprocal piston 86 which is in alignment with the cover wheel abutment 82.

The cylinder 84 is supplied by air through a pair of conduits, either hose or piping, attached to the four way air valve 88. The valve 88 is of the ¼ inch single solenoid type, such as manufactured by Automatic Valve Company of Novi, Mich., Model L0703-AAWR-AA, and the position of the air valve 88 is determined by its electrically operated solenoid.

The air valve 88 is connected by a supply conduit attached to a combination filter, regulator and air lubricator of the type manufactured by Monnier Inc. of Algonac, Mich., Model B3-31002. The regulator 90 is connected to a compressed air source as normally available in printing shops.

The position of the stack of sheets within the conveyor 18 is determined by a transducer 92, preferably of the light sensing type, and the light sensor 92 employs a light transmittable cable 94 connected to the relay 98. The light sensor 92 is mounted upon a bracket 96 attached to the base side rail 14 as will be appreciated from FIG. 3. The relay 98 is manufactured by Microswitch Corporation of Freeport, Ill., Model MPV-11, and includes a circuit control card No. MPA-1 which matches the light sensor 92 which is also of the MPF-1 type manufactured by Microswitch Corp. The light sensor 92 is adjusted to be sensitive to the amount of light entering the sensor, and as later described, the sensor 92 will determine the presence of the stacked sheets as it approaches the light sensor.

In the drawings, the stacks of sheets to be printed are represented at 100, and the stack includes a front end 102 and a rear end 104. The end 102 represents the forward end of the stack 100 relative to its direction of movement through the printer, which is toward the left as viewed in FIGS. 1 and 2.

The stack 100 also includes a side edge 106. In most instances, the stack 100 will consist of paper sheets forming a directory, catalog, specification book, or the like, and preferably, the printer is located immediately "behind" the sheet cutter or trimmer which has formed the side edge 106. The stack 100 may be bound along its side edge opposite to side edge 106, or, possibly, the stack 100 will be bound at a later time, holes may be punched in the stack for binding in a looseleaf cover, or other techniques may be used to retain the sheets forming the stack 100 during normal use.

The stack 100 is supplied to the printer conveyor 18 by a belt conveyor 108, usually leading from the stack edge cutter, not shown, and the conveyor 108 may include a stack guide 110 which will position the stack 100 as it leaves the conveyor 108 and enters the conveyor 18.

A belt conveyor 112 may be mounted at the left end of the printer to receive the printed stack 100 after it leaves the conveyor 18. Of course, it will be appreciated that the conveyors 108 and 112 may take a variety of forms, and in some instances, after the printing of the stack end edge occurs no conveyor 112 may be present, but the printed stacks otherwise handled.

To use the printer of the invention, the collars 28 will be adjusted upon the columns 20 to produce the desired spacing between the lower portion of the belt 30 and the upper portion of the belt 32 to accommodate the height of the stack of sheets to be printed. Vertical adjustment of the upper conveyor 22 to vary the spacing with respect to the lower conveyor 24 is readily accomplished by the collars 28, and the tension in the chain 50 can be maintained during such adjustment by use of the idler sprocket 58 and the adjustment attainable by the pivoting of the arm 60. The position of the stop 66 may be readily adjusted in view of its threaded construction, and an operator of average skills may set up the printer to accommodate various thickness of stacks 100.

The motor 52 is energized to drive the chain 50, and the drive rollers 38 and 40 will be rotating at identical rates of rotation to produce identical rates of linear displacement of the belts 30 and 32. A stack 100 is fed into the conveyor 18 from the belt conveyor 108, and properly oriented thereto by the guide 110.

Upon the conveyor 18 receiving the stack 100 from the conveyor 108, the stack will move to the left, FIGS. 1 and 2, and the stack front end 102 will pass adjacent the sensor 92. In this manner, the sensor 92 will immediately be aware of the position of the stack 100 within the conveyor 18 and the signal produced by the sensor 92 indicating a pre-determined position of the stack front end 102 is fed into the relay 98 wherein a pre-determined time delay is initiated. Such time delay is determined by the location of the printing desired on the stack side edge 106 with respect to the stack ends 102 and 104.

After the pre-determined time duration determined by relay 98 passes the relay 98 will energize the solenoid of the air valve 88 which will shift the air valve and supply compressed air to the printer wheel actuator cylinder 84. Such compressed air will extend the piston 86 to engage the cover wheel abutment 82 and impart a counter-clockwise rotation to the cover wheel 80 and the printer wheel 74 as viewed in FIG. 2.

FIG. 5 illustrates the position of the printer wheel 74 prior to engagement of the cylinder piston 86 with the abutment 82. As will be appreciated from FIG. 5, a clearance 114 exists between the printer wheel 74 and the stack side edge 106 as the stack 100 is moving past the printer head 68. However, upon the piston 86 engaging the cover wheel abutment 82 the slight counter-clockwise rotation that occurs of the printer wheel 74 will engage the first type element 78 with the stack side edge 106, as apparent in FIG. 6. As the type 78 has previously been inked, the first type element will transfer ink to the stack side edge 106, and frictionally engage the side edge. This frictional engagement establishes a driving relationship between the stack 100 and the printer wheel 74, and as the stack 100 is translated past the printer wheel 74 the printer wheel will rotate and sequential type elements 78 will engage the stack side edge 106 and imprint the side edge as desired. Upon the last type element 78 engaging the side edge 106 the type 78 will clear the stack side edge, printing will be completed, and upon the stack 100 completely clearing the printer wheel 74, the printer wheel will return to its original position as shown in FIG. 5.

After printing of the stack side edge 106 the stack 100 will continue through the conveyor 18 and be deposited upon the belt conveyor 112, or other receiving component. The conveyor 18 is ready to receive another stack of sheets from conveyor 108, and the printing process will continue at a high production rate.

The rolling application of the type 78 with respect to the stack side edge 106 will present a dense and sharp image upon the stack side edge, and due to the slight compression of the stack 100 by the conveyors 22 and 24 during printing, and the fact that the printer receives the stack 100 immediately after the stack has been trimmed, the side edge 106 will be planar and printable with the printer wheel 74.

The operation of the printer head 68, as described above with respect to re-indexing itself for the next printing operation, and inking the type 78, forms no part of the invention, and is inherent in the operation of the printer head model as identified above.

Figure 7:
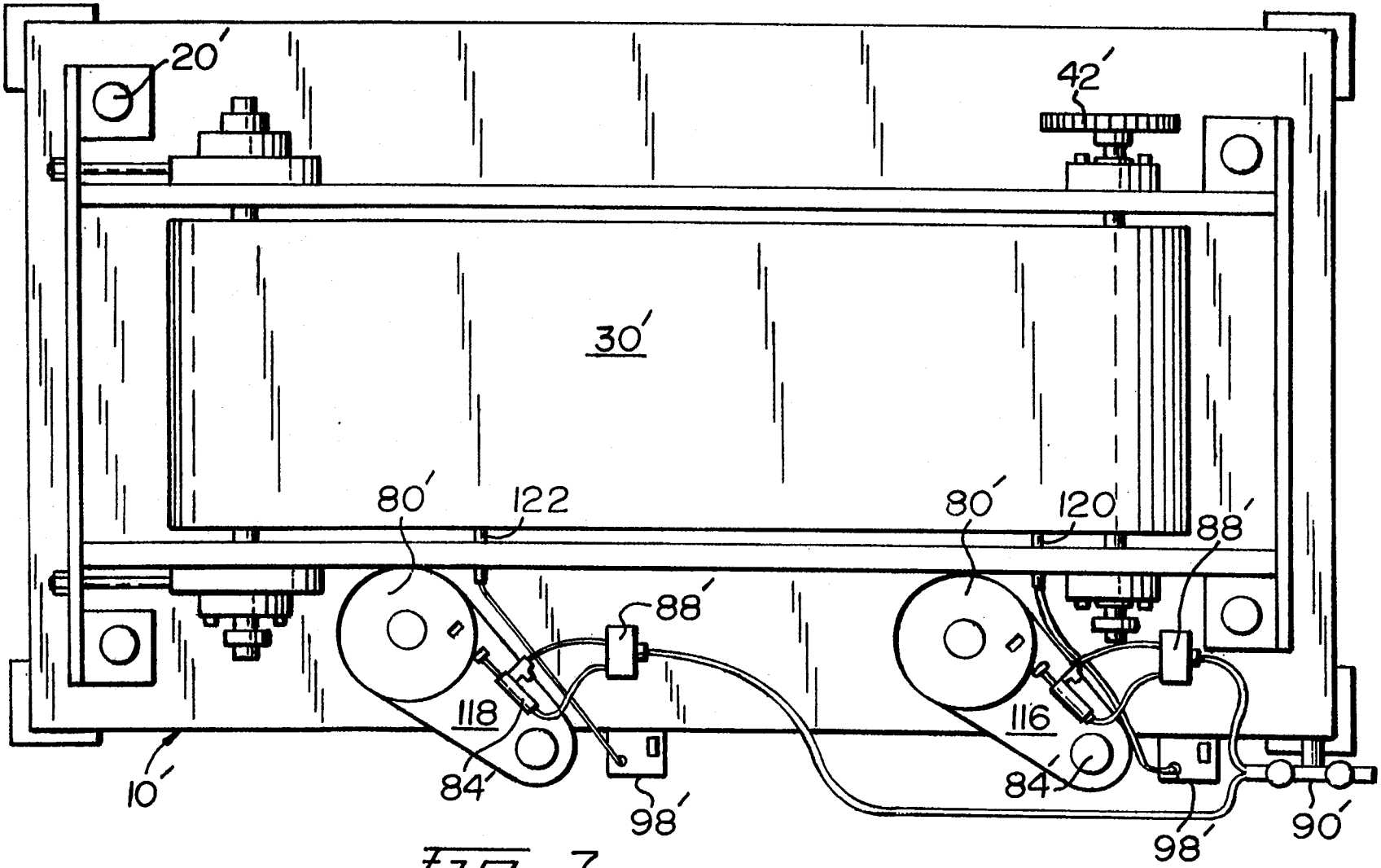
FIG. 7 is a top plan view of another embodiment of a stacked sheet side edge printer utilizing the inventive concepts wherein two colors of ink may be sequentially applied to the stack side edge.

A variation of the invention is shown in FIG. 7 which is a plan view of a printer utilizing the inventive concepts capable of printing two colors upon the stack side edge. The components of the embodiment of FIG. 7 which are identical to those previously described are indicated by primed reference numerals and operate identically to the similar components previously described. In the embodiment of FIG. 7, printer heads 116 and 118 are mounted upon the base 10' in the manner aforedescribed. The printer heads 116 and 118 may be identical in construction and operation, the only difference being that the type upon the printer wheels will differ, and usually, the color of the ink within the printer heads will differ. The sensor 120 will sense the leading edge of the stack entering the conveyor 118, and initiate operation of the printer head 116. The sensor 122 will sense the position of the stack leading edge as it approaches printer head 118, and initiate the operation of printer head 118, and it will be appreciated that each printer head 116 and 118 operates independently, and each will impart an imprint to the stack side edge 106. The use of two printer heads 116 and 118 permits variation of type to be applied to the stack side edge, the indicia colors may differ, or "shadows" may be added by the printer head 118 to the imprints that have been applied by the printer head 116. It is appreciated that various modifications to the inventive concepts may be apparent to those skilled in the art without departing from the spirit and scope of the invention.

I claim:

1. The method of printing the side edge of a stack of sheets having upper and lower sheet layers, spaced first and second end edges and a substantially flat elongated side edge defining a plane intersecting the end edges comprising the steps of:

(a) translating the stack of sheets in an uncompressed state in a given direction parallel to the stack side edge plane, (b) compressing the upper and lower sheet layers toward each other in a direction transverse to the stack side edge plane to compress the stack and maintain its form, (c) while under compression translating the stack in said given direction substantially parallel to the plane and length of the stack side edge in the direction of the first edge, (d) sensing the position of the stack during translation, and (e) printing the stack side edge upon the stack being located at a pre-determined position.

2. The method of printing the side edge of a stack of sheets as in claim 1, wherein the step of sensing the position of the stack comprises sensing the position of the stack first edge during translation of the stack.

3. The method of printing the side edge of a stack of sheets as in claim 1, wherein the step of printing the stack side edge comprising engaging the stack side edge with a rotary printing head and printing the stack side edge during stack translation.

4. The method of printing the side edge of a stack of sheets as in claim 2, wherein the step of sensing the position of the stack includes sensing the position of the stack first edge during stack translation and producing a timed electrical signal to initiate the printing of the stack side edge.

5. Apparatus for printing the side edge of a stack of sheets having upper and lower sheet layers, first and second end edges and a substantially flat elongated side edge defining a plane intersecting the end edges comprising, in combination, a supply belt conveyor conveying the stack of sheets in a given direction parallel to the stack side edge plane, an elongated stack guide located adjacent said supply belt conveyor engaging the stack side edge maintaining the stack side edge parallel to said given direction, a stack compressor receiving the stack from said supply belt conveyor engaging the upper and lower sheet layers compressing the stack in a direction transverse to the stack side edge plane, translation means [for]translating the stack through said stack compressor in a direction substantially parallel to the plane and length of the stack side edge in the direction of the first edge, sensing means adjacent said translation means sensing the position of the stack within said translation means, a printer located adjacent said stack compressor printing the stack side edge during translation, and control means interconnecting said sensing means and said printer to actuate said printer at a pre-determined position of the stack during translation.

6. Apparatus for printing the side edge of a stack of sheets as in claim 5, said stack compressor comprising a belt conveyor support, said translation means comprising a belt conveyor having upper and lower movable belts, the stack being located between said upper and lower belts.

7. Apparatus for printing the side edge of a stack of sheets as in claim 6, upper and lower drive rollers, respectively, connected to and driving said upper and lower belts, an electric motor, and a flexible drive element drivingly interconnecting said drive rollers and said motor to rotate said drive rollers at identical rates of rotation.

8. Apparatus for printing the side edge of a stack of sheets as in claim 7, adjustable means supporting said belt conveyor support determining the spacing between said upper and lower belts

9. Apparatus for printing the side edge of a stack of sheets as in claim 5, said printer comprising a rotary wheel having type mounted thereon, the engagement of said type with the stack side edge during stack translation causing said printer rotary wheel to rotate and imprint the stack side edge, a printer wheel actuator mounted adjacent said printer wheel and operated by said control means initially rotating said printer wheel type into engagement with the stack side edge upon the stack reaching said pre-determined position.

10. Apparatus for printing the side edge of a stack of sheets as in claim 9, said printer wheel actuator comprising an air operated expansible chamber motor.

11. Apparatus for printing the side edge of a stack of sheets as in claim 5, said sensing means comprising a light sensitive transducer producing an electrical signal upon sensing the position of the stack, said control means receiving said signal.

* * * * *